United States Patent [19]

Toledo

[11] Patent Number: 5,031,945

[45] Date of Patent: Jul. 16, 1991

[54] MOUNT FOR PANIC DEVICE

[75] Inventor: George F. Toledo, Fall Brook, Calif.

[73] Assignee: Thomas Industries Inc., Los Angeles, Calif.

[21] Appl. No.: 444,720

[22] Filed: Dec. 1, 1989

[51] Int. Cl.[5] ..... E05B 65/10

[52] U.S. Cl. ..... 292/336.3

[58] Field of Search ..... 70/92, 451; 292/21, 292/92, DIG. 65, DIG. 53, DIG. 64, 336.3, 337

[56] References Cited

U.S. PATENT DOCUMENTS

| | | | |
|---|---|---|---|
| 2,869,353 | 1/1959 | Imhoff, Jr. | 70/451 |
| 2,919,571 | 1/1960 | Welch | 70/451 |
| 3,186,199 | 6/1965 | Schwartz | 70/370 |
| 3,307,384 | 3/1967 | Sinervo | 70/370 |
| 3,334,500 | 8/1967 | Berjarano . | |
| 3,659,445 | 5/1972 | Eads et al. | 70/451 |
| 3,663,047 | 5/1972 | Zawadzki . | |
| 3,702,549 | 11/1972 | Solovieff et al. | 70/451 |
| 3,899,907 | 8/1975 | Prahl | 70/370 |
| 3,940,886 | 3/1976 | Ellingson, Jr. . | |
| 3,993,335 | 11/1976 | Schmidt . | |
| 4,083,590 | 4/1978 | Folger . | |
| 4,130,306 | 12/1978 | Brkic . | |
| 4,225,163 | 9/1980 | Hubbard et al. . | |
| 4,295,673 | 10/1981 | Miller . | |
| 4,418,552 | 12/1983 | Nolin | 70/92 |
| 4,570,471 | 2/1986 | Crepinsek | 70/451 |
| 4,576,023 | 3/1986 | Crepinsek | 70/451 |
| 4,773,682 | 9/1988 | Saelzer | 292/DIG. 53 |
| 4,839,988 | 6/1989 | Betts et al. . | |

*Primary Examiner*—Eric K. Nicholson

*Attorney, Agent, or Firm*—Hill, Van Santen, Steadman & Simpson

[57] ABSTRACT

A mounting arrangement for mounting a panic exit device to a midrail of a door provides for a foolproof and quick attachment of the device to the door. The invention includes only two formed tabs insertable into matching recesses in the active stile of the door, and a clamping bar with two set screws holding a remote end of the device to the midrail of the door. The arrangement requires a minimum of machining, eliminating the need to match screw holes between the midrail of the door and the panic exit device, and reduces required precision in mounting such a device to a door midrail.

17 Claims, 2 Drawing Sheets

FIG. 5
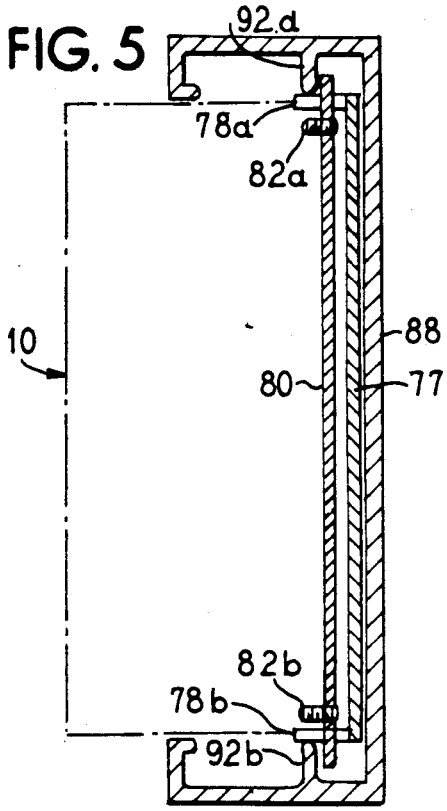
FIG. 4
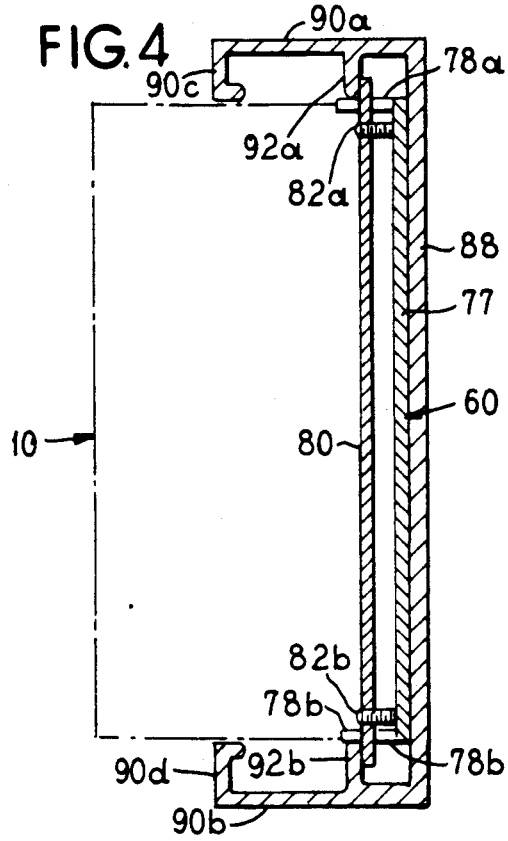
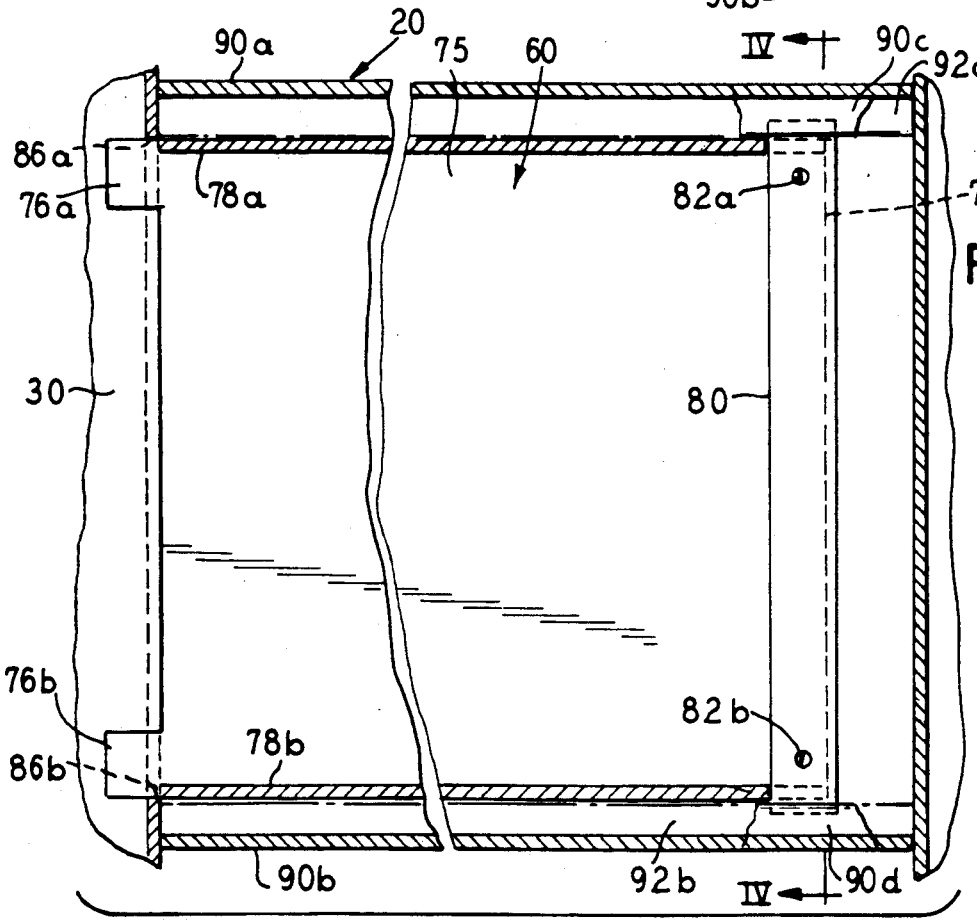
FIG. 3

MOUNT FOR PANIC DEVICE

BACKGROUND OF THE INVENTION

This invention relates to a mounting means for a panic exit device.

There are numerous types and styles of mechanisms used for operating popular commercial or public door latches, including a panic bar release arrangement, or panic exit device, mounted on the inside of the door for rapid and foolproof actuation of the mechanism, to open the door. Such arrangements are characterized by readily accessible manual actuators for use in a panic or emergency situation.

A desirable feature in an installation of this type of panic exit device is a minimum size of an active door stile containing the latching arrangement such as a bolt assembly, and a minimum size of the panic exit device. This is particularly desirable with glass doors which derive their aesthetic quality from their uncluttered look. U.S. Pat. No. 4,839,988, assigned to the assignee of the present application, discloses such a panic exit device and door stile arrangement. It is desirable to provide an exit device which may be easily and economically mounted to a door stile, particularly to this type of door stile, and enhances the aesthetic quality of the door assembly. U.S. Pat. No. 4,839,988 discloses such a device but requires a plurality of screws attaching the exit device to a middle panel area or middle rail of the door. Mounting the exit device to the door thus presents a time consuming and labor intensive operation.

U.S. Pat. No. 3,663,047, U.S. Pat. No. 3,940,886, U.S. Pat. No. 3,993,335 and U.S. Pat. No. 4,083,590 disclose panic exit devices which are attached to their respective doors by screws. In U.S. Pat. No. 3,993,335 the exit device is secured to the door by a combination of shoulder screws and set screws engageable to the shoulder screws. In all these listed patents, a screwed connection into the door or stile is required to hold the panic exit device assembly to the door.

It is therefore new to the art to provide a means of attaching a panic exit device to a door which: is economical to manufacture; provides for a quick and foolproof installation or removal of a malfunctioning panic exit device; uses a minimum of drilled and tapped screwed connections into the door or door stile; and provides a rugged construction.

SUMMARY OF THE INVENTION

The present invention relates to a means of mounting a panic exit device to a door. More particularly, the invention relates to a mounting means for mounting a panic exit device which resides recessed interior of a middle horizontal rail of the door.

Objects of the invention are to provide a means of attaching a panic exit device to a door which:

provides a simple, foolproof manner of attachment;

provides for a minimum of required loose parts, such as screws;

provides for a rapid removal and reinstallation of the panic exit device to the door;

provides a panic exit device which requires no screw holes drilled into the door for installation;

provides an aesthetically pleasing attachment with a minimum of screwed connections visible; and provides for a relatively adjustable fit up without need for aligning screw holes thus reducing manufacturing and maintenance time. These objects are inventively achieved in that:

the panic exit device mounting arrangement requires no attachment screw holes in either the panic exit device or the door;

the panic exit device can be quickly attached or removed from the door for initial installation or maintenance purposes;

the panic exit device mounting arrangement provides a rugged and secure means of mounting such a device into a midrail of the door;

the panic exit device mounting arrangement does not require the time and precision to align screw holes in the panic exit device to screw holes in the door, as in the prior art;

the panic exit device is more easily manufactured, eliminating the machining required for threaded screw holes into the body of the panic exit device;

the panic exit device comprises a protruding actuating lever which is easily received into an opening of the active stile to engage a latching mechanism residing therein, the device is properly mounted to the active stile by inward insertion into the midrail and then lateral transport to abut the active stile, the lever inserting into the opening and engaging the latching mechanism;

the panic exit device comprises formed tabs easily insertable into notches or recesses in the door, stile and an extending portion which is captured between the door and a clamping bar, the clamping bar using two set screws to generate pressing of the extending portion between the clamping plate and the door;

the formed tabs and the extending wall portion are made integral with a back side of the mounting base of the panic exit device, thus the mounting arrangement comprises only one additional separate piece, the clamping plate with integral set screws; and the recesses for receiving the tabs are formed integral with an opening for receiving the actuating lever of the device into the active door stile, thus the combined opening in the active stile comprises a one hole configuration, simplifying fabrication, layout and fit ups.

BRIEF DESCRIpTION OF THE DRAWINGS

FIG. 3 is a front elevation of the panic exit device mounting arrangement with panic exit device mechanical components not shown for clarity.

FIG. 4 is a sectional view along line IV—IV of FIG. 3 showing the clamping plate in an engaged condition.

FIG. 5 is a sectional view along line IV—IV of FIG. 3 showing the clamping plate in a loosened condition.

DESCRIPTION OF THE PREFERRED EMBODIMENTS

Figure 1:
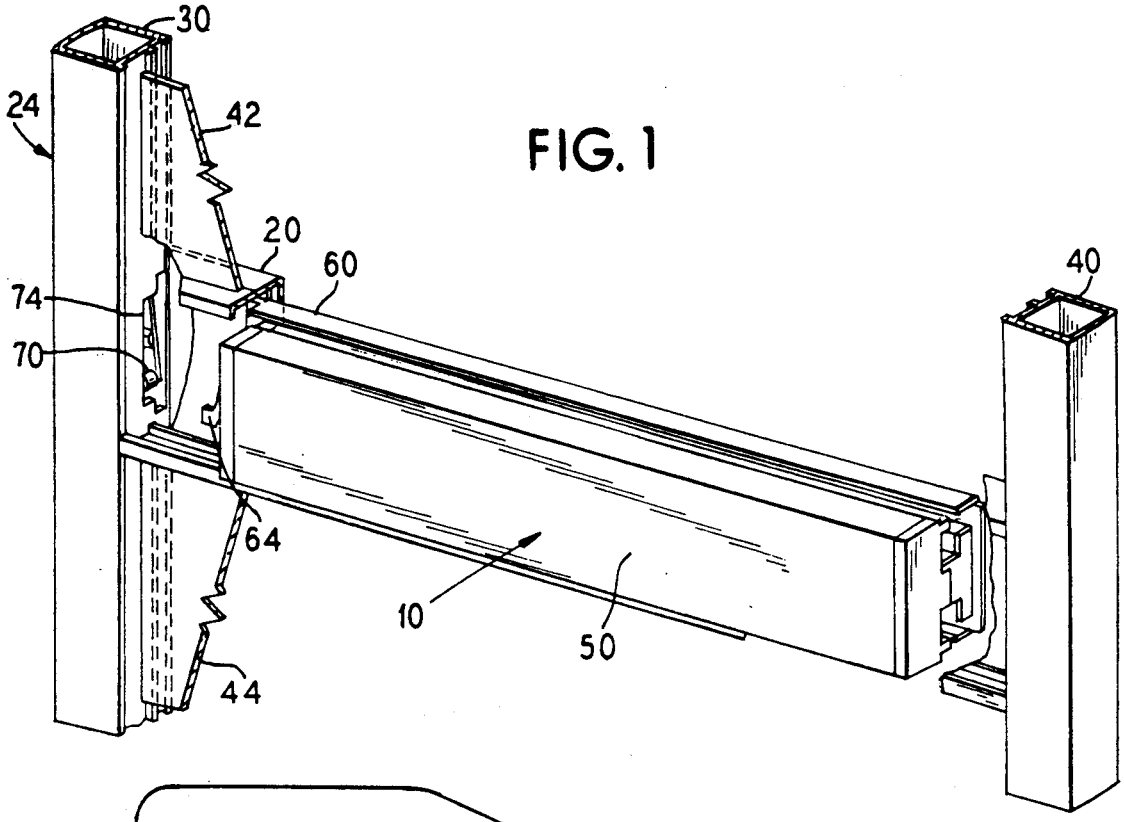
FIG. 1 is a fragmentary perspective view of an embodiment of the invention showing the mounting relationship of the panic exit device, the inactive and active stiles, and mounting rail of the door.

FIG. 1 shows a door actuating device such as a panic exit device 10 mounted into a mid-rail 20 of a door shown generally at 24. The mid-rail 20 attaches to an active stile 30 at one end and an inactive stile 40 at another end. The term "active stile" refers to a portion of a door which houses a latching mechanism. The term "inactive stile" refers to a portion of the door holding a hinging arrangement for mounting the door 24. The active stile 30 holds bolting mechanisms therein for securing the door 24 to a door frame (not shown). The active stile 30, the mid-rail 20 and the inactive stile 40 act as a frame to hold a first panel 42 on a top end of the door 24, and act as a frame to hold a second panel 44 on a bottom end of the door 24. In the preferred embodiment, the panels 42,44 are composed of glass, however other materials may be used.

The panic exit device 10 comprises a push bar 50 engaged by a user attempting to exit the door 24. The push bar 50 is advanced inwardly toward a mounting frame or base member 60 to disengage the bolting mechanisms from the door frame. A lever 64 protrudes from the panic exit device into an opening 74 of the active stile, and engages an actuating pin 70 and accomplishes the disengagement of the bolting mechanism when the push bar 50 is activated. Such a panic exit device is more completely described in U.S. Pat. No. 4,839,988. Although the preferred embodiment of the invention relates to a panic exit device as described in U.S. Pat. No. 4,839,988, the invention could be utilized in other door actuating devices and mounting arrangements for such devices are encompassed by the invention.

Figure 2:
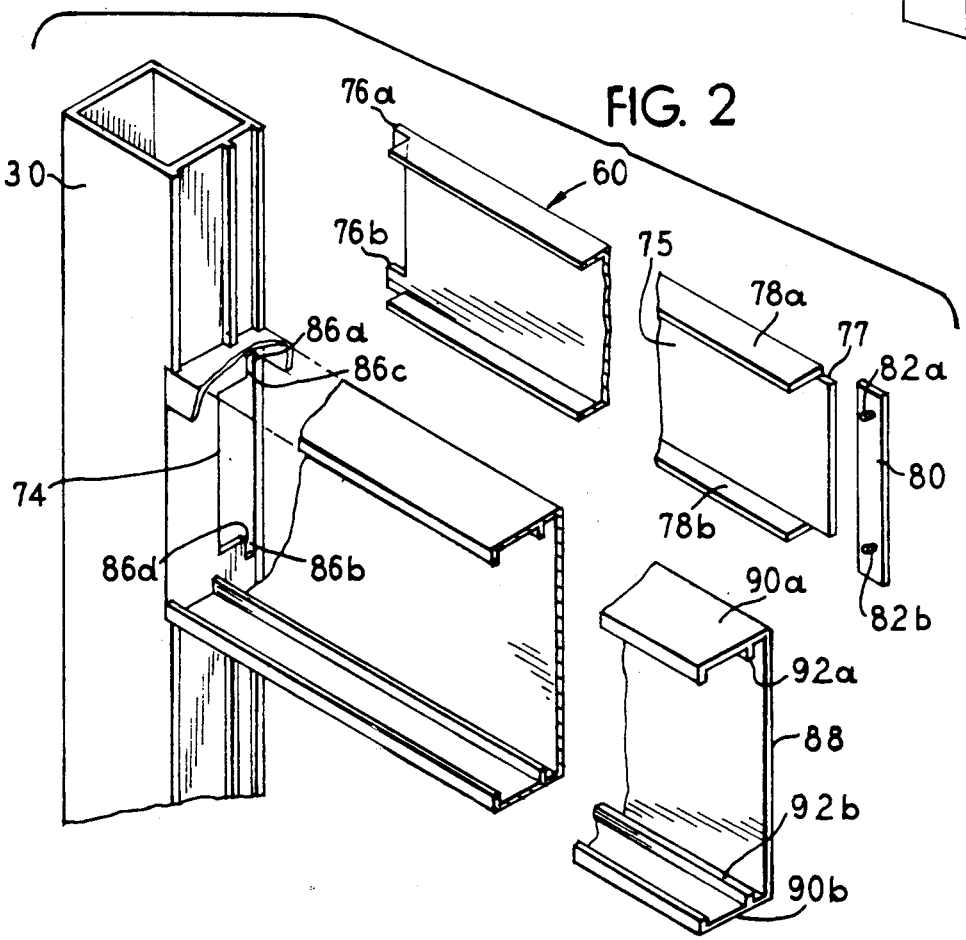
FIG. 2 is a fragmentary perspective exploded view of the mounting rail of the door and mounting components of the panic exit device mounting arrangement.

FIG. 2 shows an exploded view of the active stile 30 and the mid rail 20 along with the base member 60. The base member 60 is shown in simplified form without showing the plurality of mechanical attachments required as further described in U.S. Pat. No. 4,839,988. The base member 60 provides an upstanding plate member 75 which extends at a first end in two formed tabs **76*a*, 76*b* which protrude toward the active stile 30. The plate member 75 extends at a second end in extending portion 77. The plate member 75 is formed with two flanges 78*a*, 78*b* which provide rigidity of the base 60. The flanges 78*a*, 78*b* are formed along the length of the plate member 75 but terminate at the second end, short of the extending portion 77. Thus, the extending portion 77 is a flat member without flanges. A wedging means, such as a clamping bar 80 is shown which includes two set screws 82*a*, 82*b***.

The active stile 30 comprises an opening 74 for access to the latching mechanism by the panic exit device. The opening 74 further provides two recesses **86*a*, 86*b* wherein the formed tabs 76*a*, 76*b* are inserted to mount the panic exit device 10. The recesses 86*a*, 86*b* provide side walls 86*c*, 86*d* which prevent lateral movement of the tabs 76*a*, 76*b* with respect to the recesses 86*a*, 86*b* and thus prevent outward extraction of the base 60 from the midrail 20**, at the first end.

The midrail 20 is shown comprising a generally C-shaped cross section with a backwall or upstanding leg 88 and two flange portions **90*a*, 90*b*. Flange portions 90*a*, 90*b* further provide inwardly projecting rails 92*a*, 92*b* arranged parallel to the upstanding leg 88. In the preferred embodiment the rails 92*a*, 92*b* substantially span the length of the midrail 20 but this is for aesthetic reasons and to add some structural rigidity. A pair of tabs or short rails could be used instead to abut the clamping plate 80** as described below.

FIG. 3 shows the base member 60 installed into the midrail 20 with the formed tabs **76*a*, 76*b* inserted into recesses 86*a*, 86*b*. The clamping bar 80 is in position pressing extending portion 77 and plate member 75 against upstanding leg 88 of the midrail 20**.

FIG. 4 shows the base 60 mounted and secured into the midrail 20. The clamping bar 80 is pressed against rails **92*a*, 92*b* by inward extension of the set screws 82*a*, 82*b* against the extending portion 77 of the plate member 75. Inward extension of the set screws 82*a*, 82*b* presses the extending portion 77 against the upstanding leg 88 and creates an opposing pressing force of the clamping bar 80 to the rails 92*a*, 92*b*. Thus, the base member 60 is prohibited from outward extraction from the midrail 20 by interference of the clamping bar 80 with the rails 92*a*, 92*b* and the base member 60 is prohibited from lateral sliding movement along the midrail 20 by a frictional attachment of the plate 75 against the upstanding leg 88 caused by tightly pressing the extending portion 77 and the plate member 75 onto the upstanding leg 88. The rails 92*a*, 92*b* could be configured as tabs or short rails to abut the clamping bar 80 and any such abutting member attached to the midrail 20** is encompassed by the present invention.

The mounting base 60 is shown with flange **78*b* resting on the rail 92*b*** for support.

FIG. 5 shows the base 60 in a condition preceding removal (or alternatively in an uncompleted stage of installation). The clamping bar 80 is in a loosened configuration with respect to the extending portion 77. The set screws **82*a*, 82*b* have been disengaged from the extending portion 77 and the clamping bar 80 is now in a position to be maneuvered away from the extending portion 77 and outwardly of the rails 92*a*, 92*b*. The base 60 can be slid away from the active stile 30 to disengage the lever 64. The panic exit device can then be removed outwardly of the midrail 20**.

Installation of the panic exit device 10 is thus a simple process. The device 10 is inserted inwardly of the midrail 20 and slid toward the active stile 30. The lever 64 engages the pin 70 and the tabs **76*a*, 76*b*, are received by the recesses 86*a*, 86*b*. The clamping bar 80 is maneuvered between the extending portion 77 and the rails 92*a*, 92*b*. The set screws 82*a*, 82*b* are extended inwardly of the device 10 against the extending portion 77 which presses the extending portion 77 against the upstanding leg 88. The panic exit device 10 is thus mounted inside the midrail 20**.

Although other modifications and changes may be suggested by those skilled in the art, it is the intention of the inventor to embody within the patent warranted hereon all changes and modifications as reasonably and properly come within the scope of his contribution to the art.

I claim as my invention:

1. A mounting apparatus for mounting a door actuating device to a door comprising:

a mounting frame secured to said door actuating device, said mounting frame having a lead portion insertable into a door stile of said door; and a clamping bar having adjustable wedging means located at a discrete distance from said door stile for providing a pressing engagement at a distance from said door stile between said mounting frame and a portion of said door.

2. A mounting apparatus as claimed in claim 1, wherein said adjustable wedging means comprises a set screw received in said bar, said bar being engageable with said door and said set screw being engageable with said mounting frame so as to cause a wedging action between said door and said mounting frame as said set screw is adjusted.

3. A mounting apparatus for mounting a door actuating device to a door comprising:

a mounting frame secured to said door actuating device, wherein said door provides two recesses in a door stile thereof, and said mounting frame provides a lead portion comprising two tabs at a first end of said mounting frame insertable into said recesses, said recesses preventing said mounting frame from outward extraction from said door at said first end; and a clamping bar having adjustable wedging means located at a discrete distance from said door stile for providing pressing engagement at a distance from said door stile between said mounting frame and a portion of said door.

4. A mounting apparatus as claimed in claim 1, wherein said mounting frame comprises at an end thereof, an extending portion engageable by said wedging means to be pressed against said door by selected adjustment of said wedging means.

5. A mounting apparatus for mounting a door actuating device to a door comprising:

a mounting frame secured to said door actuating device, said mounting frame having a lead portion insertable into a door stile of said door; and a bar having adjustable wedging means for providing pressing engagement between said mounting frame and said door exterior of said door style wherein said door comprises rail members having bearing surfaces and said bar resides between said bearing surfaces and said mounting frame, extension of said wedging means toward and against said mounting frame causes said mounting frame to press against said door and said bar to press against said bearing surfaces.

6. A mounting apparatus for mounting a door actuating device to a door, wherein said door actuating device comprises a protruding actuating lever, said door providing a door stile having a door latching mechanism therein, said door latching mechanism engageable by said lever when said door actuating device is mounted to said door, comprising:

a mounting frame secured to said door actuating device, said mounting frame having a lead portion insertable into said door stile of said door; and a bar having adjustable wedging means for providing pressing engagement between said mounting frame and a portion of said door exterior of said door stile, said door latching mechanism engageable by said lever when said lead portion is inserted into said door stile.

7. A mounting apparatus for mounting a door actuating device to a door comprising:

a mounting frame secured to said door actuating device, said mounting frame having a lead portion insertable into a first portion of said door; and a bar having adjustable wedging means for providing pressing engagement between said mounting frame and said door wherein said door comprises a midrail member positioned between two door stiles and said door actuating device is mounted recessed therein, said mounting frame being pressed by said wedging means against a back wall of said midrail member. said wedging means toward and against said mounting frame causes said mounting frame to press against said door and said wedging means to press against said rail members.

8. A mounting apparatus as claimed in claim 7, wherein said midrail member comprises a C-shape having inwardly directed rail portions arranged parallel to said back wall of said midrail member; said mounting frame comprises an extending portion which resides adjacent said back wall; and said wedging means resides adjacent said rail portions, between said rail portions and said extending portion, extension of said wedging means pressing said extending portion against said back wall and pressing said wedging means against said rail portions.

9. A mounting apparatus as claimed in claim 8, wherein said lead portion comprises two tabs insertable into recesses formed in one of said stiles of said door.

10. A mounting apparatus as claimed in claim 9, wherein said door actuating device comprises an actuating lever and said one door stile provides a latching mechanism residing therein engageable by said actuating lever; and said recesses are formed as part of a single opening in said one door stile, said single opening also providing access for said lever of said door actuating device to engage said latching mechanism.

11. A mounting apparatus as claimed in claim 10, wherein said recesses provide sidewalls, said sidewalls preventing lateral movement of said tabs residing interior of said recesses, with respect to said recesses, and thus preventing outward extraction of said mounting frame at said tabs.

12. A mounting apparatus as claimed in claim 2, wherein said wedging means comprises two set screws.

13. A method for attaching a panic exit device to a door comprising the following steps:

providing a door having a C-shaped midrail, an active door stile having a latching mechanism residing therein, and an inactive door stile, said midrail spanning between said active door stile and said inactive door style, said active door stile having an opening for access to said latching mechanism, said opening communicating into said midrail, said midrail having a back wall and two flange portions, said flange portions having inwardly projecting rail members arranged parallel with said back wall;

providing a panic exit device having a push bar movably mounted to a base member, inward movement of said push bar by a person actuating said panic exit device, said device having an actuating lever protruding from a first end, said actuating lever being engageable with said latching mechanism, said actuating lever moving in response to actuation of said panic exit device, to actuate said latching mechanism;

providing a clamping bar having two set screws threaded therein;

inserting said panic exit device into said C-shaped midrail;

laterally sliding said panic exit device toward said active door stile, inserting said actuating lever into said opening to engage said latching mechanism, inserting a lead portion of said base member at said first end into said opening;

maneuvering said clamping bar inwardly of said rail members and repositioning said clamping bar in an orientation abutting said rail members on one side and adjacent a second end of said panic exit device on a second side of said clamping bar to capture said panic exit device between said clamping bar and said back wall; and driving said set screws toward said panic exit device, engaging said panic exit device and pressing said panic exit device against said back wall.

14. A method for attaching a panic exit device to a door comprising the following steps:

providing a door having an anchoring structure mounted thereon, an active door style having a latching mechanism residing therein, said active door style having an opening for access to said latching mechanism;

providing a panic exit device having a push bar movably mounted to a base member, said device having an actuating lever protruding from a first end, said actuating lever being engageable with said latching mechanism, said actuating lever moving in response to actuation of said panic exit device, to actuate said latching mechanism;

providing a clamping bar having at least one set screw threaded therein;

laterally sliding said panic exit device toward said active door style, inserting said actuating lever into said opening to engage said latching mechanism, inserting a lead portion of said base member at said first end into said opening, positioning said panic exit device adjacent to said anchoring structure;

maneuvering said clamping bar between said base member and said anchoring structure, said clamping bar in an orientation abutting said anchoring structure at a first face of said bar and said bar adjacent a second end of said base member at a second face of said clamping bar to capture said base member between said clamping bar and said door; and driving said at least one set screw toward said base member, engaging said base member and pressing said base member against said door.

15. A method according to claim 14, wherein said lead portion of said base member at said first end comprises two tabs.

16. A method according to claim 14, wherein said anchoring structure comprises two frame members having L-shaped cross-sections, extending outwardly from a face of said door, said frame members having turned legs in facing relationship, said base member having a portion which is inserted between said frame members and against said door, said clamping bar inserted between said frame members and abutting an inside surface of the turned legs of said L-shaped members, said clamping bar arranged outwardly of said base member which is arranged adjacent to the door, driving said set screws towards and against said base member presses said clamping bar against said turned legs and presses said base member against said door.

17. A method according to claim 16, wherein said base member further comprises a protruding portion which is engaged by said clamping bar.

* * * * *